United States Patent [19]

Ringel

[11] Patent Number: 4,915,039

[45] Date of Patent: Apr. 10, 1990

[54] PROCESS FOR HEAT-TREATING REFUSE AND EQUIPMENT TO CARRY OUT THE PROCESS

[75] Inventor: Helmut Ringel, Niederzier-Hambach, Fed. Rep. of Germany

[73] Assignee: Kernforschungsanlage Juelich GmbH, Juelich, Fed. Rep. of Germany

[21] Appl. No.: 221,593

[22] Filed: Jul. 20, 1988

[30] Foreign Application Priority Data

Jul. 24, 1987 [DE] Fed. Rep. of Germany ..... 3724563

[51] Int. Cl.[4] ..... F23D 3/00

[52] U.S. Cl. ..... 110/346; 110/165 A; 110/204; 110/216; 110/345

[58] Field of Search ..... 110/346, 204, 216, 345, 110/165 A, 259, 258

[56] References Cited

U.S. PATENT DOCUMENTS 4,617,180 10/1986 Vogg ..... 423/240
4,620,492 11/1986 Vogg et al. ..... 110/216 X
4,739,715 4/1988 Couarc'h et al. ..... 10/346
4,782,772 11/1988 Chughtai et al. ..... 110/204 X
4,796,595 1/1989 Hashizaki et al. ..... 110/204 X

FOREIGN PATENT DOCUMENTS 0186224 7/1986 European Pat. Off. .
2154156 5/1973 Fed. Rep. of Germany .
2946408 6/1980 Fed. Rep. of Germany .

OTHER PUBLICATIONS

KHD Humboldt Wedag 2g, Brochure, no date.
R. Rasch, Flugasche, Schmelzschlacke, Mullschlacke und Ihre Industrielle Verwertung, 1984, Chekiken-Ztg Chem. Apparatus, pp. 564–567.

*Primary Examiner*—Edward G. Favors
*Attorney, Agent, or Firm*—Shlesinger & Myers

[57] ABSTRACT

A process for heat-treating refuse comprising the steps of decomposing in a combustion furnace a quantity of refuse into slag, emitted gas and fly dust. The fly dust is separated into a fine dust fraction and a coarse dust fraction. The coarse dust fraction is fed back to the combustion chamber, and the fine dust fraction is treated for removal of desired constituents.

18 Claims, 2 Drawing Sheets

PROCESS FOR HEAT-TREATING REFUSE AND EQUIPMENT TO CARRY OUT THE PROCESS

The invention concerns a process for heat treating refuse, in particular special refuse, wherein this refuse is fed to a combustion chamber where it is burnt while slag and fly dust are being formed, the fly dust evacuated together with the emitted gas then being separated. The invention also concerns equipment to carry out this process using a combustion oven supplied with combustion gas, with a furnace feed to introduce the refuse, with an emitted gas pipe, with a slag discharge means and also with a separator to separate at least part of the flue ash from the exhaust gas.

As a rule refuse is heat treated in the so-called trash incinerators. There the refuse is fed to combustion chambers and burnt while forming slag, emitted gas and fly dust. The exhaust gas contains the combustion products $H_2O$, $CO_2$ and residual noxious substances such as hydrocarbons and traces of heavy metals. The fly dust is filtered out of the exhaust gas and deposited as residue. The salts accumulating in the purification of the exhaust gases are treated similarly. The noxious substances developed thereby are halogens, residual hydrocarbons and the volatile heavy metals, the main ingredients being the slag forming agents.

Trash incinerators made by KHD Humboldt Wedag AG, Cologne D-5000 are known to heat treat special refuse, where the comminuted refuse is burned in a combustion chamber using industrial oxygen and old oil at temperatures in excess of 1,600° C. As a result, all the organic components or noxious substances are dissociated and are transferred into the exhaust gas. The slag being formed is collected in a sub-oven and thereupon will be suitable for dumping or for use in civil engineering or sub-grade construction. The noxious substances in the emitted gas are removed by an electric filter and by a wet washer by means of cold traps and activated carbon absorbers. The dissipated heat is used to heat a medium which then is fed to a two-stage turbine to generate electric power.

The known method for heat treating refuse is the fact that large amounts of fly dust arise which carry noxious substances, especially volatile heavy metals. The final storage is possible only in special trash dumps, or in underground dumps. This is a poor solution because there might be long-term ecological damage.

Procedures are described in the German patent document No. A 29 46 408, European patent document No. A 0 186 224 and German patent document No. A 21 54 156, whereby particulate wastes collected by chemical or physical methods and laden with noxious substances, especially zinc, cadmium or copper, are mixed into a molten mineral material such as refuse slag. The purpose of these procedures is to make the noxious substances dumpable by melting them together with the dust-like particles into the slag so that they will be enclosed thereby. Supposedly these noxious substances cannot leach out of the slag following solidification, that is, no degradation of water and air is expected long-term when such solidified slags are deposited in trash dumps.

Contrary to the above assumption, however, such deposition of noxious substances is unreliable, that is, it is not sure after all that upon a long time, the noxious substances shall still all be enclosed in the slag. Moreover it is inevitable that a fine fly dust will develop during the melting stage, and that the noxious substances will attach to this dust because of its large surface, and that part of the noxious substances will not be enclosed by the slag. Thereupon this fly dust will stress the air.

It is known from Rasch, "Flugasche, Schmelzschlacke, Muellschlacke und ihre industrielle Verwertung", Chemiker-Zeitung, Chemische Apparatur, year 84, #17, 1960, pages 564–7, especially page 566, to separate fly ash from hard or brown coal dust furnaces by means of cyclones, electric filters and to remove it either directly or to return it to the furnace to remelt it. Besides this method being unknown so-far when burning refuse, fine dusts also are developed herein which are highly laden with noxious substances, which are not removed in the separators and thereby are introduced into the air.

The object of the invention is to find a process wherein substantially lesser amounts of fly dust contaminated with heavy metals will accumulate and making it possible to recover the heavy metals. Another object is to provide equipment with which to carry out this process.

Regarding the process, this problem is solved by the invention in that the fly dust is divided into a coarse-dust fraction and into a fine-dust fraction and only the course-dust fraction is integrated into the liquid slag while the adhering volatile noxious substances are evaporated and while the noxious substances adhering to the fine-dust fraction are recovered.

Accordingly the present invention recycles the fly dust which is partly fed back into its source where it is integrated into the slag accumulating as the refuse is being burned. The temperature and the dwell time of the slag may be so adjusted that the volatile noxious substances adhering to the fed-back fly dust practically evaporate completely whereby essentially only the mineral dust portion of the fly ash remains in the slag and leaves the combustion furnace together with the slag. The volatile noxious substances so released during the cooling of the emitted gas will again deposit on the fly dust, in particular on the fine dust particles. These fine dust particles are collected in the manner of the preferred implementation of the invention, their quantity being relatively slight. The noxious substances adhering to these particles are recovered, whereby practically no fly dust laden with noxious substances is developed.

It was found appropriate to divide the coarse and the fine dust fractions around a particle size of 50 microns (u). The division can be carried out using tube filters, cyclones and/or electric filters, through other apparatus also may be used.

Regarding the treatment of the fine-dust fraction, it is suggested to subject the emitted gas with the fine-dust fraction to a wet-physical and/or a wet chemical separation and to split then the fine-dust fraction into heavy metals and slag portions. The separation can be carried out in such a manner that the water of combustion condenses in the exhaust gas whereby the fine-dust fraction will be thereby flushed out of the exhaust gas and the condensate shall be subsequently distilled, the heavy metals being recovered from the distillate residue. Because of these process steps, the $CO_2$—$H_2O$ mixture is separated by condensing the $H_2O$ fraction, the portion of the fine dust with apposed heavy metals, any heavy metal vapors, further HCL and $SO_2$ being separated. The subsequent distillation of the condensate so obtained produces a pure $H_2O$ head product and bottoms consisting of HCL acid with dissolved heavy metals and undissolved fine dust. The heavy metal can be recovered by wet-chemical separation methods, for instance by precipitation.

The binding or integration of the fed-back coarse-dust fraction into the liquid slag can be carried out in several ways. Illustratively the fed-back fly dust can be introduced directly into the combustion chamber and there be bound into the liquid slag. This can be done by blowing the fed-back fly dust onto the liquid slag. Appropriately too, the fed-back fly dust shall be introduced into a combustion zone of the combustion chamber so hot that the particles at least turn pasty, that is that they shall adhere to each other and accumulate as enlarged particles.

The fed-back fly-dust also can be fed into the refuse ahead of the combustion chamber and be introduced together with that refuse in the said chamber. For this kind of feed especially, the fly dust should be previously agglomerated, that is, for instance it should be pelletized and/or pressed.

In another implementing mode, the invention keeps the slag liquid in the combustion chamber over a substantial time until there is maximum evaporation of the noxious substances, and this time easily can exceed one hour. As a result the inherent noxious substances that would be soluble in the dump will be expelled. In particular this mode assures that the volatile heavy metals introduced with the fed-back fly dust into the slag shall be evaporated. Appropriately, the temperature in the combustion chamber, especially in the vicinity of slag formation, shall be kept above 1,200° C., preferably in the 1,350° C. zone. Expulsion of the noxious substances then further is assisted by the melting slag being thoroughly mixed and by additional metallurgical steps being applied, for instance refining with oxygen and/or with chlorinated gas.

Especially advantageous effects shall be obtained when using essentially industrial oxygen to burn the refuse. Thereby the emitted gas volume is much reduced, and thereby the controlled separation of the coarse-duct fraction and its recycling are much simplified. Again combustion of oxygen significantly simplifies the handling of fine-dust fraction enriched with heavy metals and the separation of these heavy metals. The main ingredient no longer is the virtually uncondensing $N_2$, but essentially the two condensing gases $H_2O$ and $CO_2$. As a result the noxious substances can be separated from the emitted gas system by purely physical separation methods as described above, namely condensation and evaporation. While such separation is energy-intensive, on the other hand it avoids or reduces the use of chemicals in the emitted gas purification.

Further advantages obtained by burning industrial oxygen are that the thermal efficiency will be increased and that large amounts of nitrogen will be prevented from being sucked in from the environment, from being contaminated and from needing immediate and costly purification. Moreover, industrial oxygen allows problem-free high combustion temperatures and long emitted gas dwell times. Industrial oxygen shall be most suitable of all for special refuse because organic ingredients will be practically decomposed in their entirety. The substantially lower amounts of emitted gases allow binding the fly dust into the slag because the emitted gas rates also are correspondingly low, that is, substantially less fly dust will be blown out.

Appropriately the burning of the refuse in the combustion chamber takes place in two stages, the refuse in the first stage being burned and evaporated while forming a liquid slag and emitted gas, and the emitted gas being burned to completion in the second stage by adding further combustion gas. At the same time, the liquid slag more or less completely burned in the first combustion stage is kept liquid also in the second stage. In this manner the dwell times required to expel the volatile heavy metals introduced together with the fed-back fly dust can be easily achieved.

The movement of the slag through the combustion chamber can be facilitated if the slag is subjected to swing motions of the combustion chamber about a longitudinal axis.

As regards the equipment, the problem stated initially is solved by a feedback system-returning the coarse-dust fraction to the combustion chamber-being mounted between the separator separating the coarse-dust fraction of the fly ash from the emitted gas and the combustion chamber, and by at least one separation stage being present after the separator to recover the noxious substances adhering to the fine-dust fraction passing through the separator.

A condenser to separate the water of combustion with the fine-dust fraction and a distillation system for the ensuing evaporation of the water of combustion are proposed for the wet-physical and wet-chemical separation stage following the separator. This distillation system illustratively may be a rectification column. In a wet-chemical separation stage, preferably the distillate residue from the distillation system is separated into slag portions and heavy metals.

An already suggested above in relation to the process, the feedback system may be so designed alternatively as to being connected on one hand with the combustion furnace or on the other hand with the furnace feed system. In the former case the feedback system appropriately issues into the vicinity of the combustion gas supply because that is where the temperatures are highest and so that the fly dust become pasty. Additionally the feedback system may be equipped with a pelletizing and/or pressing means to agglomerate the fed-back fly dust before it enters the combustion furnace.

Appropriately, and for the reasons already stated, the combustion gas supply shall be equipped with an apparatus to feed industrially pure oxygen.

Regarding the design of the combustion furnace, it will be appropriately divided into two sequential furnace chambers, with the combustion gas essentially being fed to the first furnace chamber. The furnace chambers are divided by a partition with a passage near the furnace chamber bottom. Another supply of combustion gas may be present near the partition.

The invention provides further that a gas burner to heat the slag be mounted near the slag discharge means. This gas burner facilitates the complete burning of the slag and thereby also the expulsion from it of volatile noxious substances. A slag collecting vessel should be present in the slag discharge means to allow removing the liquid slag. The slag collecting vessel may be provided with an agitator and/or a heater in order to stir the slag and keep it liquid.

It is further suggested in the invention that the combustion furnace companies support burners to maintain a temperature of at least 800° C.; this is especially necessary when the combustion gases are exclusively industrial oxygen.

To facilitate the movement of the slag, the base of the combustion furnace should slope downward at least at the front. It is further suggested that the combustion furnace be pivotably suspended about a longitudinal axis for the same purpose. Alternatively or even in combination, pivotability also may be provided about the transverse axis. Where the furnace guide and the emitted gas pipe are mutually coaxial, the longitudinal axis about which the combustion can pivot also should be coaxial thereto.

For the sake of safety, the furnace feed means shall be provided with an input lock for the refuse. This lock should be relatively compact and comprise a vacuum system to evacuate the air in the input lock in the closed condition. Also a rinsing system to feed $CO_2$ into the input lock and also into the entire adjoining furnace feed pipe shall be provided.

These steps will be required where the combustion takes place using industrially pure oxygen.

Lastly the invention proposes to equip the emitted gas pipe with a cooling system. Alternatively, however the heat of the emitted gas can be utilized to generate steam with which turbines are driven to generate electrical power.

The invention is shown in further detail by the illustrative embodiments of the drawing.

Figure 1:
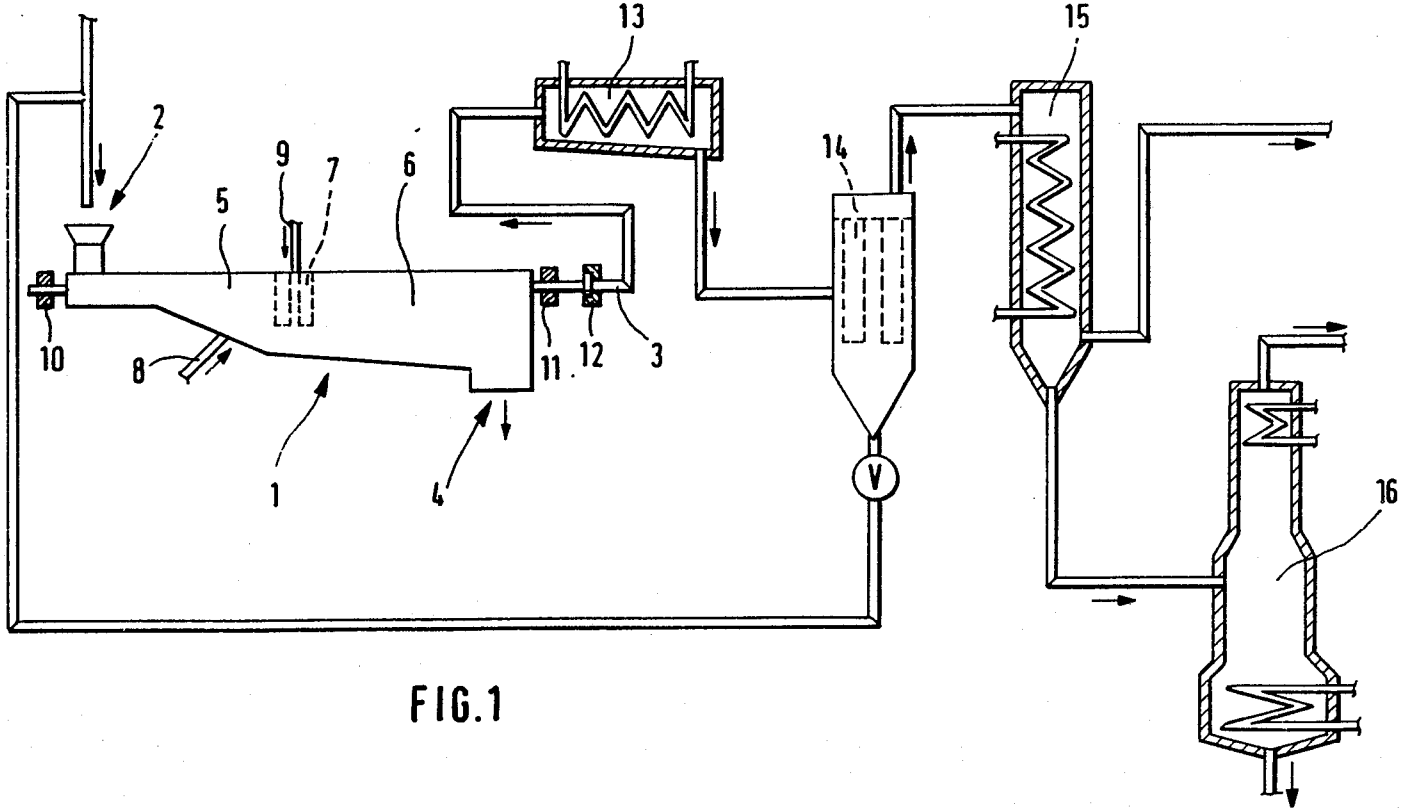
FIG. 1 is the equipment flow diagram of a trash incinerator.

The trash incinerator shown in FIG. 1 comprises a combustion furnace 1 equipped at the input side with a furnace feed means 2 and the output side with an emitted gas pipe 3 of slag discharge means 4. The furnace 1 is divided into two furnace chambers 5, 6 and the division consists of a partition 7 which does not extend to the base of the furnace chambers 5, 6.

A primary oxygen feed 8 issues into the first furnace chamber 5, while a secondary oxygen feed 9 is provided near the partition 7. The combustion furnace 1 is suspended from bearings 10, 11 so as to be pivotable about its longitudinal axis, and these bearings 10, 11 also can be moved vertically, whereby the combustion furnace 1 can be adjusted relative to a transverse axis. The maximum pivot angle about the longitudinal axis is 30°.

The emitted gas issuing from the combustion furnace 1 into the emitted gas pipe 3 passes through an emitted gas pipe coupling 12 and arrives at an emitted gas cooler 13 where it is cooled from about 1,200° C. to about 200° C. Thereupon it enters a tube filter 14 where the fly dust conveyed together with the emitted gas is divided into a coarse-dust fraction and into a fine-dust fraction. The boundary shall be at about 50 u grain size. In lieu of the tube filter 14 a cyclone may also be used, especially where there are substantial amounts of emitted gas. The coarse-dust fraction is carried downward and is admixed to the refuse before the furnace feed means 2, where called for following pelletizing and pressing. Together with the refuse, the coarse-dust fraction then returns to the combustion furnace 1 where it is bound into the liquid slag.

The fine-dust fraction now only forms a small part of the total fly dust, however it is strongly enriched with volatile heavy metals because the heavy metals agglomerate especially in the finest grain fractions less than 20 u. The fine-dust fraction so laden is fed into a condenser 15 where it is cooled to 10° C. Thereby the water of combustion will be condensed, the largest portion with fine dust enriched in heavy metals, heavy-metal vapors, HCL and so being separated. The remaining emitted gas consists essentially of $CO_2$, CO, $H_2$ and $N_2$ may be purified further in a distillation column, with the non-condensing residual gases CO, $H_2$ and N being obtained whereas $CO_2$, possibly still contaminated with $SO_2$, remains in the bottoms.

The condensate evacuated at the bottom then passes into a rectification column 16 where the water of combustion a distilled off. Pure $H_2O$ head product is obtained, also bottoms of HCL with dissolved heavy metals and undissolved fine dust. The remaining quantity of filter dust is insignificant. The heavy metal portions can be recovered by further separation procedures, so that only dump-proper residues remain of the fly dust.

Figure 2:
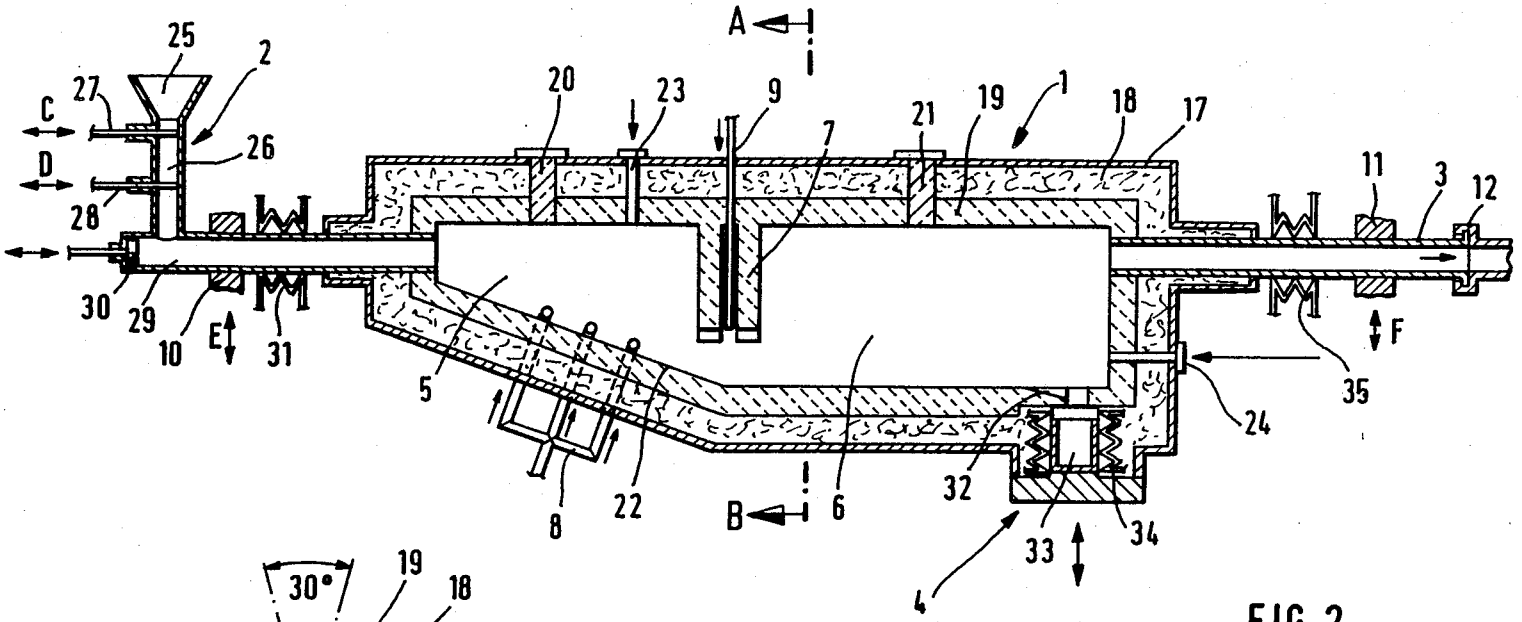
FIG. 2 is an enlargement of the combustion furnace of the incinerator of FIG. 1.
Figure 3:
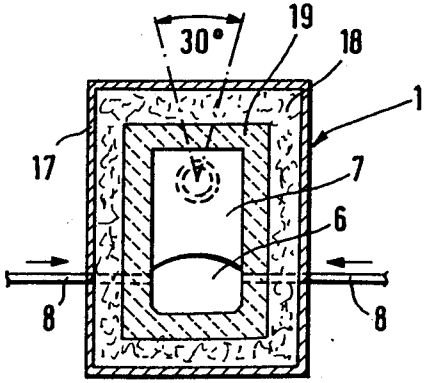
FIG. 3 is a cross-section of the combustion furnace of FIG. 2 in the plane A–B.

The combustion furnace 1 with first chamber 5 and second chamber 6 shown in detail in FIGS. 2 and 3 comprises a wall 17 consisting of an outer sheet metal or plate casing 17, a rock wool lining 18 and on the inside a furnace lining 19 of refractory bricks. The combustion in the two furnace chambers 5, 6 may be observed through two shielded windows 20, 21.

The primary oxygen feed 8 consists of three nozzles in the sidewalls of the combustion furnace 1, which are located somewhat above the downward oblique base 22 of the first furnace chamber 5. The secondary oxygen feed 9 is located near the partition 7 and ensures complete combustion of the emitted gases in the second furnace chamber 6. Additional support burners 23, 24 are provided, namely the first support burner 23 is present in the vicinity of the top side of the first furnace chamber 5 and the second support burner 24 is present in the vicinity of the slag discharge means 4. The support burners 23, 24 serve to heat the furnace prior to burning the refuse because for safety, the inside of the furnace always must be kept at least at 600° C. during combustion because non-explosive gas mixtures will be found only about that temperature.

The furnace feed means 2 comprises a hopper 25 and a trash input lock 26. This lock 26 consists of two sliders 27, 28 mounted one above the other and moving in the direction of the double arrows C, D. After the first slider 27 has been opened, as much trash can be filled as there is space between the two sliders 27, 28. After the upper slider 27 has been closed, the air is evacuated from the trash input lock 26 and $CO_2$ is flushed in. $CO_2$ furthermore is introduced into the horizontal input pipe 29 adjoining the trash input lock 26. Only then will the lower slider 28 be opened, so that the trash can drop into the input pipe 29. There it is forced by means of a push-disk 30 into the combustion furnace 1. A cooling system 31 is additionally provided to prevent the input pipe 29 from overheating.

On account of the slope of the base 22, the refuse slips inside the combustion furnace 1 to the bottom and is further pushed forward by the next refuse. The refuse is heated, dried, degassed, evaporated and burned. The combustion zone is predetermined by the position of the primary oxygen feed 8 and can be controlled by correspondingly regulating the supply.

The slag accumulating during combustion flows through a slag chute 32 into a slag receptacle 33 mounted in the slag discharge means 4. An electrical heater 34 is provided near the slag receptacle 33. After the air is shut off, the slag receptacle 33 can be moved away downward from the slag discharge means 4.

The slag is moved not only on account of the slope of the slag chute 32 but also by the possibility, already mentioned above, of pivoting the combustion furnace 1 about two axes. For that purpose the combustion furnace 1 is rotatably suspended by means of the input pipe 29 and the emitted gas pipe 3 from the bearings 10, 11. Accordingly the combustion furnace 1 can be pivoted by 30° about a longitudinal axis passing through the input pipe 29 and the emitted gas pipe 3. Additionally, the bearings 10, 11 might be made to move vertically as indicated by the double arrows E, F. Such motion can be used to additionally control the slope of the slag chute 32.

The emitted gas pipe 3 also is equipped with a cooling system 35 so that it will not overheat. The rotatably supported part of the emitted gas pipe 3 is connected by a emitted gas coupling 36 to the stationary part.

I claim:

1. A process for heat-treating refuse, comprising the steps of:

(a) decomposing in a combustion chamber a quantity of refuse into slag, emitted gas and fly dust;

(b) separating the fly dust into a fine dust fraction and a coarse dust fraction;

(c) feeding only the coarse dust fraction back to the combustion chamber; and, (d) separating the fine dust fraction into desired constituents.

2. Equipment for heat-treating refuse, comprising:

(a) a combustion furnace including a combustion gas feed, a refuse feed, a slag discharge means, and separator means for separating emitted fly dust into a coarse dust fraction and a fine dust fraction;

(b) a feedback system interconnecting said separator means and said combustion furnace for causing only the coarse dust fraction to be conveyed to the combustion furnace; and, (c) recovery means downstream of and in flow communication with said separator means for removing noxious substances adhering to the fine dust fraction.

3. Process defined in claim 1, characterized in that the splitting into coarse dust fraction and fine-dust fractions takes place at a particle size of 50 microns.

4. Process defined in claim 1, characterized in that the emitted gas with the fine-dust fraction is subjected to a wet-physical and/or a wet-chemical separation and that therein the fine-dust fraction is separated into heavy metals and slag portions.

5. Process defined in claim 4 characterized in that the separation takes place in such a way that the water of combustion in the emitted gas condenses and that thereby the fine-dust fraction is flushed out of the emitted gas and the condensate thereupon shall be distilled, with the heavy metals being recovered from the distillate residue.

6. Process defined in claim 1, characterized in that the coarse-dust fraction is fed back into the combustion chamber where it will be bound into the liquid slag.

7. Process defined in claim 6, characterized in that the coarse-dust fraction is introduced into a combustion zone within the combustion chamber hot enough to at least render the particles pasty.

8. Process defined in claim 7, characterized in that the coarse-dust fraction is added to the refuse before the combustion chamber (1) and together with this refuse is introduced into the combustion chamber (1).

9. Process defined in claim 1, characterized in that the slag is kept for a substantial time in the combustion chamber in the liquid form until the noxious substances have been evaporated as much as possible.

10. Process defined in claim 1, characterized that essentially pure industrial oxygen is used to burn the refuse.

11. Process defined in claim 1, characterized in that the refuse is burned in two stages in the combustion chamber (1), where the refuse is burned in the first stage (5) while forming a liquid slag and an emitted gas and also is evaporated, and in that the emitted gas is completely burned in the second stage (6) by further addition of combustion gas.

12. Process defined in claim 1, characterized in that the slag advance is enhanced by pivoting motions of the combustion chamber (1) about a longitudinal axis.

13. Equipment defined in claim 2, wherein said recovery means flushes the fine dust fraction out of the emitted gas and separates it into heavy metals and slag portions.

14. Equipment define in claim 2, characterized in that the feedback system includes a pressing device for the fly dust.

15. Equipment defined in claim 2, characterized in that the combustion furnace (1) is divided into two sequential furnace chambers (5, 6) with the combustion gas feed (8, 9) issuing mainly into the first furnace chamber (5).

16. Equipment defined in claim 15, characterized in that the furnace chambers (5, 6) are divided by a partition (7) providing a passage near the base (22) of the furnace chamber.

17. Equipment defined in claim 16, characterized in that a further combustion gas feed (9) is provided near the partition (7).

18. Equipment defined in claim 12, characterized in that the combustion furnace (1) is suspended so as to be pivotable about a longitudinal and/or transverse axis.

* * * * *